US006241165B1

(12) United States Patent
Bickart et al.

(10) Patent No.: US 6,241,165 B1
(45) Date of Patent: Jun. 5, 2001

(54) SPRAY NOZZLE WITH DIRECTLY MOUNTED PLATE

(75) Inventors: Jean René Bickart, Satigny (CH); Pascal Meyer, Paris (FR)

(73) Assignee: Verbena Corporation N.V., An-Curacao (NL)

( * ) Notice: Subject to any disclaimer, the term of this patent is extended or adjusted under 35 U.S.C. 154(b) by 0 days.

(21) Appl. No.: 09/582,367

(22) PCT Filed: Dec. 22, 1998

(86) PCT No.: PCT/IB98/02104

§ 371 Date: Jun. 21, 2000

§ 102(e) Date: Jun. 21, 2000

(87) PCT Pub. No.: WO99/33573

PCT Pub. Date: Jul. 8, 1999

(30) Foreign Application Priority Data

Dec. 24, 1997 (FR) ..... 97 16749

(51) Int. Cl.[7] ..... B05B 1/34

(52) U.S. Cl. ..... 239/491; 239/493; 239/496; 239/492; 239/497; 239/463

(58) Field of Search ..... 239/491, 492, 239/493, 494, 495, 496, 497, 461, 463

(56) References Cited

U.S. PATENT DOCUMENTS 1,183,393 * 5/1916 Merrell ..... 239/493
2,378,348 * 6/1945 Wilmes et al. ..... 239/491
2,753,218 * 7/1956 Kelsey et al. ..... 239/496

FOREIGN PATENT DOCUMENTS 421009 11/1964 (CH) .

* cited by examiner

*Primary Examiner*—David A. Scherbel
*Assistant Examiner*—Dinh Q. Nguyen
(74) *Attorney, Agent, or Firm*—William H. Eilberg

(57) ABSTRACT

A spray nozzle includes a central swirl chamber (9), receiving the fluid tangentially through lateral fluid inlet channels (14) from a peripheral front cavity (8), and projecting the fluid in outlet through a coaxial outlet passage (12). The coaxial outlet passage (12), the central swirl chamber (9) and the fluid inlet channels (14) are made up of ribs and recesses in a front plate (15) engaged between a nozzle (1) hollow body and a rear core (5) which is itself formed by a core rear body **(5*a*) and a rear plate (5*b*) with rear axial recess (17). Thus one can economically produce fluid inlet channels (14) and a central swirl chamber (9) with coaxial outlet passage (12) and rear axial recess (17)** with very accurate dimensions, thereby ensuring satisfactory reproducibility of the features of the fluid spray jet at the outlet.

6 Claims, 4 Drawing Sheets

SPRAY NOZZLE WITH DIRECTLY MOUNTED PLATE

TECHNICAL FIELD OF THE INVENTION

The present invention concerns nozzles for spraying liquids, which can be used in the most diverse applications, such as spray pumps, evaporators, combustion burner nozzles and internal combustion engine injectors, for example.

The invention applies more particularly to spray nozzles in which the liquid to be sprayed is fed into a central swirl chamber via lateral fluid inlet passages injecting the liquid tangentially, the liquid then leaving the central swirl chamber through a coaxial outlet passage.

Spray nozzles with a central swirl chamber generally spray liquids well.

Usually they are made of metal, by conventional machining processes, and comprise a hollow nozzle body, with an external peripheral wall having a longitudinal axis, and a radial anterior external wall incorporating an axial outlet hole for the outflow of the fluid. The central swirl chamber is delimited by a peripheral wall with a shape of revolution about a longitudinal axis, an anterior wall with a coaxial outlet passage, and a posterior wall. The anterior wall with the coaxial outlet passage is formed by said radial anterior external wall, which is perpendicular to the longitudinal axis. At least one lateral fluid inlet passage is provided in the peripheral wall, opening into the central swirl chamber, and shaped to suit the inlet flow of fluid and to inject the fluid tangentially into the central swirl chamber.

In use, the spray nozzles produce an outflow in the form of a liquid spray in the form of fine droplets, the flow being generally conical in the direction of the longitudinal axis, and the droplets being distributed at random within the cone.

In machining metal spray nozzles on an industrial scale, there is a broad spread of the main outflow parameters, namely the size of the droplets, the outlet angle value, and the spectrum of distribution of the droplets within the cone.

The spread in the outflow characteristics leads to considerable difficulties in using the spray nozzles. In particular, this leads to a random increase in the level of carbon monoxide and in the level of hydrocarbons in the exhaust gas, a reduction in combustion efficiency, and soiling of heat exchange walls around the combustion area.

The spreads of the liquid outflow parameters are due to the spread of the dimensions of the fluid inlet passages and, most importantly, the dimensions of the central swirl chamber. It is not economically feasible to reduce the spreads of these dimensions with conventional manufacturing methods which machine the metal parts constituting the prior art spray nozzles, because this would require very accurate machining and this cannot be done economically, especially in the case of small spray nozzles.

Document CH-421 009 A proposes to facilitate manufacture by making the peripheral and anterior walls of the swirl chamber, the coaxial outlet passage and the lateral fluid inlet passages in the form of posterior openings and grooves in an anterior plate fastened into a hollow nozzle body and pressed against an anterior external wall by a posterior core.

The anterior plate and the posterior core are both retained laterally and independently of each other by the peripheral wall of the nozzle body.

This structure with an attached anterior plate does not lend itself to economic and reproducible mass production of spray nozzles including a coaxial posterior opening in the posterior core extending the swirl chamber towards the rear.

A coaxial posterior opening of this kind can in particular be beneficial for stabilizing the spray cone at the nozzle outlet.

STATEMENT OF THE INVENTION

The problem addressed by the present invention is that of designing a new spray nozzle structure with a central swirl chamber that can be manufactured economically and accurately using high-precision techniques, so that the fluid inlet passages and the central swirl chamber dimensions are precise and reproducible, and so that a posterior swirl chamber opening is precisely centered.

The invention aims in particular to provide small spray nozzles of this kind, in which the fluid inlet passages and the central swirl chamber are of small size, in such a way that the necessary dimensional accuracy leads to absolute accuracies in the order of only a few microns.

Another problem, addressed by some embodiments, of the invention is that of avoiding the risks of damage to the spray nozzle if the fluid contained in the spray nozzle freezes.

To achieve the above and other objects, the invention provides a spray nozzle having:

- a hollow nozzle body with a peripheral external wall having a longitudinal axis and a radial anterior external wall incorporating an axial outlet hole,
- a central swirl chamber delimited by a peripheral wall with a shape of revolution about the longitudinal axis, an anterior wall incorporating a coaxial outlet passage smaller than the axial outlet hole, and a posterior wall,
- at least one lateral fluid inlet passage in the peripheral wall, opening into the central swirl chamber and shaped to inject the fluid tangentially into the central swirl chamber,
- an anterior plate fastened into the hollow nozzle body and bearing against the radial anterior external wall, incorporating posterior openings and grooves forming the peripheral and anterior walls at least of the central swirl chamber, the coaxial outlet passage and said at least one lateral fluid inlet passage, and
- a posterior core fitted into the hollow nozzle body, and having peripheral fluid feed passages, and an anterior face pushing said at least one attached anterior plate towards said radial anterior external wall of the hollow nozzle body,
- and in which:
  - the posterior core comprises a posterior core body retained in the hollow nozzle body by fixing means, and a posterior plate held in position by the posterior core body and bearing axially against the anterior plate to form the posterior wall of the central swirl chamber and to delimit said at least one fluid inlet passage towards the rear,
  - the anterior and posterior plates are provided with relative centering means for centering the plates relative to each other about the longitudinal axis,
  - the posterior plate comprises, along the longitudinal axis, a posterior recess with a smaller cross section than the central swirl chamber, and
  - at least one of the anterior and posterior plates is mounted with radial clearance in the hollow nozzle body.

One option is for the relative centering means for the plates to be formed on their respective front bearing surfaces.

The relative centering means for the plates preferably comprise a posterior peripheral rib on the anterior plate in which the periphery of the posterior plate engages.

BRIEF DESCRIPTION OF THE DRAWINGS

Other objects, features and advantages of the present invention will emerge from the following description of particular embodiments, given with reference to the accompanying drawings, in which.

DESCRIPTION OF THE PREFERRED EMBODIMENTS

Figure 1:
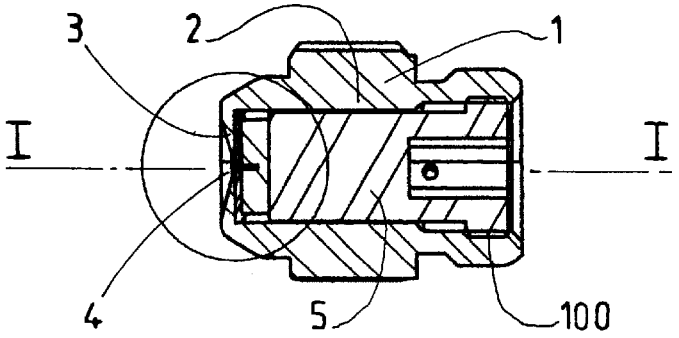
FIG. 1 is a general side view in longitudinal section of one particular embodiment of a spray nozzle in accordance with the invention.

In all the embodiments shown in the figures, a spray nozzle in accordance with the present invention comprises a hollow nozzle body 1, for example a cylindrical hollow body, delimited by a peripheral external wall 2 with a longitudinal axis I—I and with a shape of revolution, and closed by a radial anterior external wall 3 incorporating an axial outlet hole 4.

A posterior core 5 is fitted into the hollow nozzle body 1 and has peripheral passages 6 and 7 for feeding fluid to one or more peripheral anterior cavities 8, 8*a* and 8*b*. Provision is made for access between the posterior core 5 and the radial anterior external wall 3, by using either an attached radial anterior external wall 3, or an attached posterior core 5. In the embodiments shown in the figures, the posterior core 5 is fastened into the hollow nozzle body 1, whereas the radial anterior wall 3 is in one piece with the peripheral external wall 2.

The spray nozzle in accordance with the invention further comprises a central swirl chamber 9, delimited by a peripheral wall 10 with a shape of revolution about the longitudinal axis I—I, an anterior wall 11 incorporating a coaxial outlet passage 12 for the outflow of fluid, and a posterior wall 13. The central swirl chamber 9 is connected to the peripheral anterior cavities 8, 8*a* and 8*b* by at least one lateral fluid inlet passage 14, opening into the central swirl chamber 9 and shaped to convey the inlet flow of fluid and to inject the fluid tangentially into the central swirl chamber 9, for example in a direction substantially perpendicular to the longitudinal axis I—I.

Figure 2:
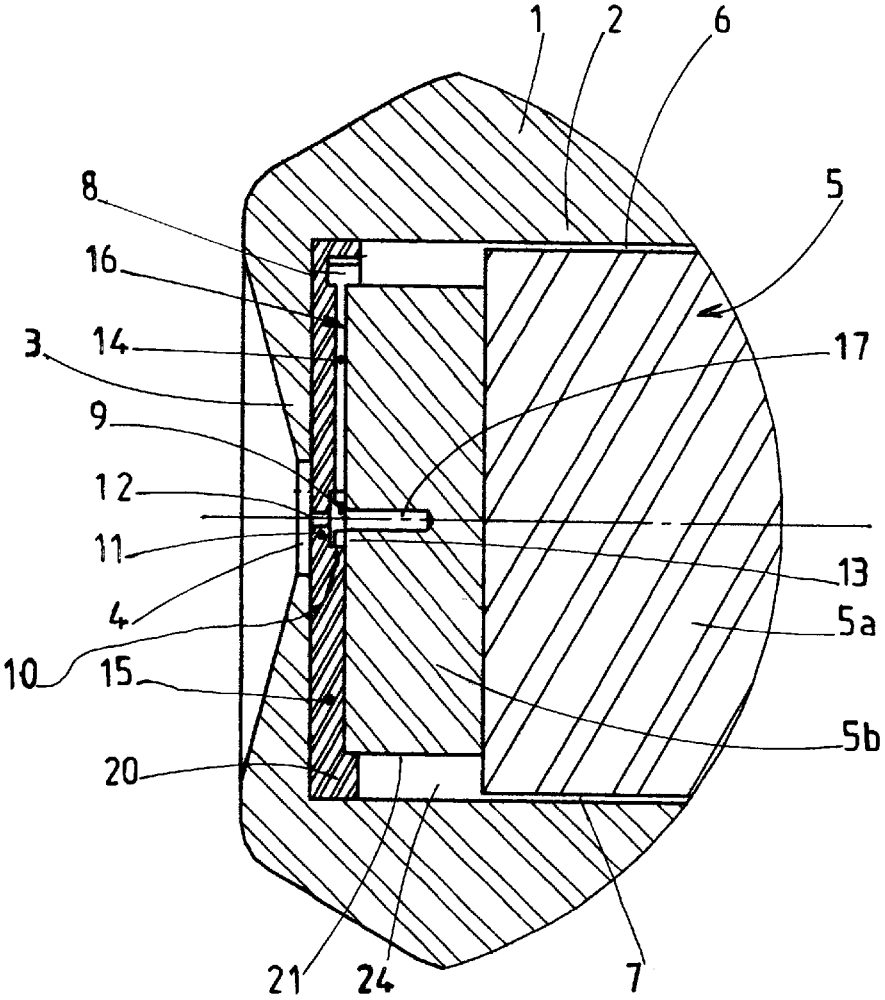
FIG. 2 is a view to a larger scale of the anterior part of the nozzle shown in FIG. 1.

In the embodiment shown in FIG. 2, the axial outlet hole 4 in the radial anterior external wall 3 is larger than it strictly needs to be, that is to say the coaxial outlet passage 12 of the spray nozzle is smaller than the axial outlet hole 4. The peripheral wall 10 and the anterior wall 11 of the central swirl chamber 9, the coaxial outlet passage 12 and the lateral fluid inlet passage(s) 14 are formed by precisely made grooves and openings in an anterior plate 15 fastened into the hollow nozzle body 1.

The attached anterior plate 15 bears against the posterior face of the radial anterior external wall 3 of the hollow nozzle body 1, and incorporates an axial hole constituting the coaxial outlet passage 12. The anterior plate 15 incorporates posterior grooves forming said at least one lateral fluid inlet passage 14, and an axial posterior opening constituting the central swirl chamber 9.

Figure 3:
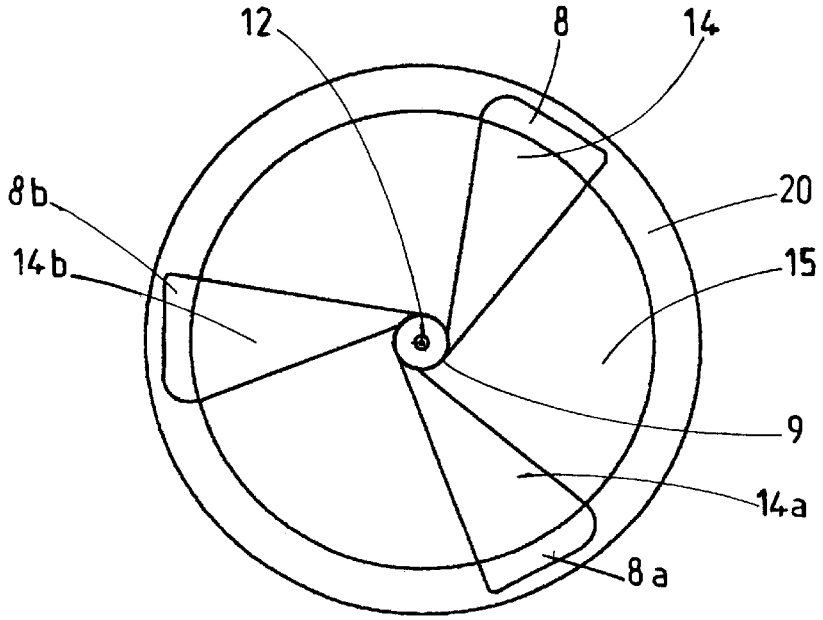
FIG. 3 is a rear view of the posterior face of an anterior plate from the embodiment shown in FIG. 2.
Figure 4:
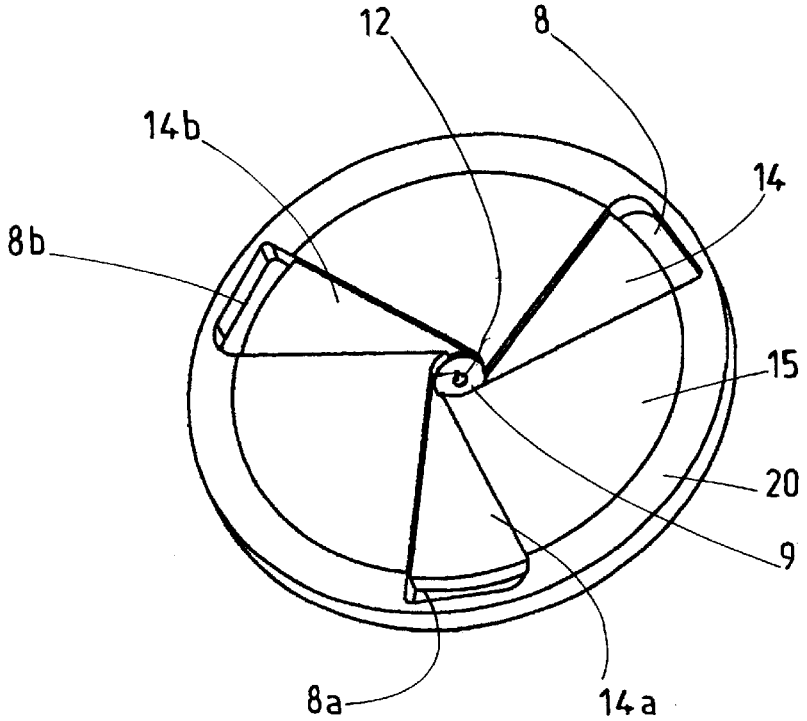
FIG. 4 is a perspective view of the posterior face of the anterior plate shown in FIG. 3.

In the embodiment shown in FIGS. 3 and 4, the anterior plate 15 is shaped to form a plurality of lateral inlet passages. For example, it is provided with three posterior grooves 14, 14*a* and 14*b* constituting three lateral inlet passages regularly distributed at the periphery of the central swirl chamber 9, and constituting the three peripheral anterior cavities 8, 8*a* and 8*b*.

The anterior face 16 of the posterior core 5 delimits the lateral fluid inlet passage(s) 14 and the central swirl chamber 9. The anterior face 16 of the posterior core 5 incorporates an axial posterior recess 17, facing the coaxial outlet passage 12, extending the central swirl chamber 9 towards the rear and having a smaller cross section than the swirl chamber 9.

In the embodiment shown in FIG. 2, the anterior plate 15 is centered in the hollow nozzle body 1 by the periphery of the anterior plate 15, which engages with little or no clearance in the cylindrical bore delimited by the peripheral external wall 2 of the hollow nozzle body 1.

Alternatively, the anterior plate 15 can have, on its anterior face, a coaxial circular rib forming a lip surrounding the coaxial outlet passage 12, said rib engaging substantially without clearance in the axial outlet hole 4 in the radial anterior external wall 3 of the hollow nozzle body 1 to centre it.

The anterior plate 15 is pressed between the radial anterior external wall 3 and the posterior core 5, which is in turn retained in the hollow nozzle body 1 by fixing means, for example by screwing into a threaded portion 100 of the hollow body 1 shown in FIG. 1.

According to the invention, and as seen more clearly in FIG. 2, the posterior core 5 comprises a posterior core body 5*a* retained in the hollow nozzle body 1 by the fixing means previously mentioned, and a posterior plate 5*b* held against the anterior plate 15 by the posterior core body 5*a*. The posterior plate 5*b* therefore forms the posterior wall 13 of the central swirl chamber 9 and delimits the lateral fluid inlet passage(s) 14 towards the rear.

The posterior plate 5*b* incorporates also an axial hole, along the longitudinal axis, constituting the posterior recess 17 with a smaller cross section than the central swirl chamber 9, extending the central swirl chamber 9 towards the rear.

The anterior plate 15 and posterior plate 5*b* are provided with relative centering means for centering them relative to each other. The relative centering means can comprise male-female interengagement means provided at respective positions on the two plates. Because the plates can be manufacturing using accurate manufacturing tools, it is important for the centering means also to be provided in the plates themselves.

At least one of the anterior 15 and posterior 5*b* plates is mounted with radial clearance in the hollow nozzle body, for example the peripheral radial clearance 24 around the posterior plate 5*b*. The plates 15 and 5*b* are therefore centered reliably and very accurately. As a result the posterior opening 17 is perfectly coaxial with the swirl chamber and with the coaxial outlet passage 12.

In the embodiment shown in FIGS. 2 to 4, the relative centering means for the plates 15 and 5*b* comprise a posterior peripheral rib 20 on the anterior plate 15 in which at least part of the periphery 21 of the posterior plate 5*b* engages.

Both plates 15 and 5*b* are pressed axially between the radial anterior external wall 3 and the posterior core body 5*a*.

The anterior plate 15 is centered in the hollow nozzle body 1 by its periphery, which engages with little or no clearance in the cylindrical bore delimited by the peripheral external wall 2. Alternately, centering could instead be assured by the periphery of the posterior plate 5*b* engaged in the peripheral external wall 2.

A variant in which the fluid inlet passages are formed by grooves on the posterior plate 5*b*, or on the two plates 15 and 5*b*, instead of on the anterior plate 15, is equally feasible.

Figure 5:
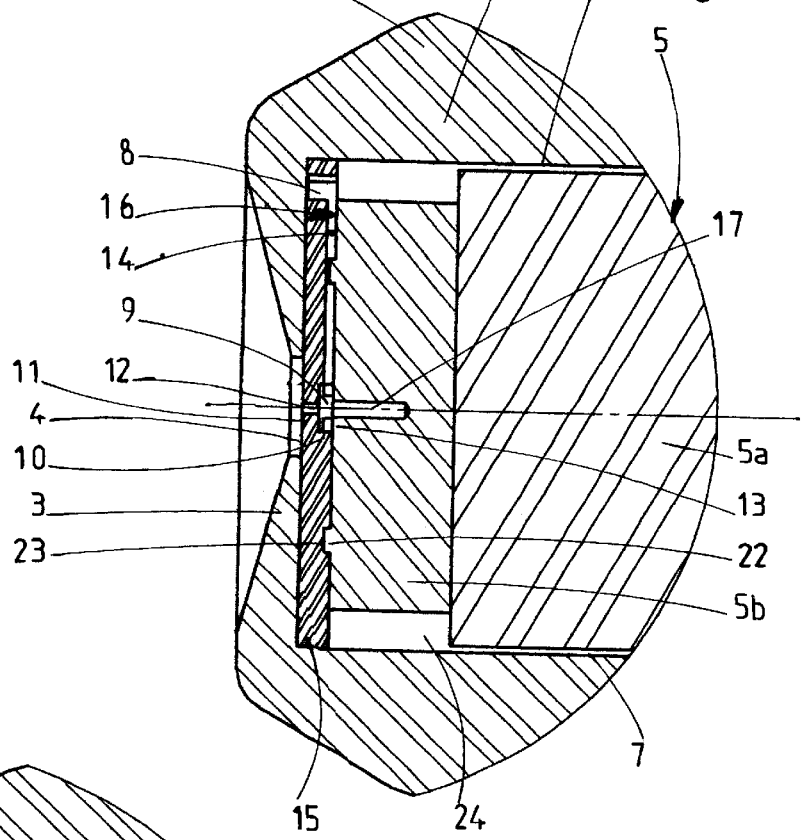
FIG. 5 is a partial side view in longitudinal section and to a larger scale of a second embodiment of a spray nozzle in accordance with the invention.

The structure of the embodiment shown in FIG. 5 is substantially the same as the structure of the first embodiment shown in FIG. 2. The difference concerns the means for relative centering of the plates 15 and 5*b*. In this case, the relative centering means are provided on the respective bearing front faces of the plates 15 and 5*b*. For example, excrescences 22 are provided on the anterior front face of the posterior plate 5*b* and engage in corresponding recesses 23 in the anterior plate 15, or vice versa. The anterior plate 15 then has no peripheral rib in which the periphery of the posterior plate 5*b* engages.

The embodiments shown in FIGS. 2 to 5 constitute a single-stage fluid feed system, that is to say one in which the lateral fluid inlet passages convey the fluid directly from the peripheral anterior cavity 8 to the swirl chamber 9.

Figure 6:
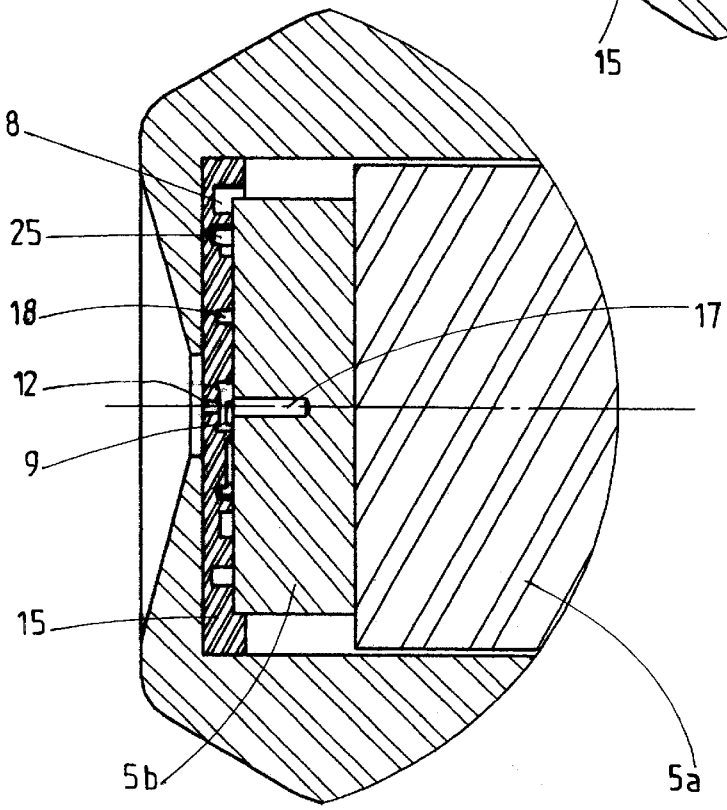
FIG. 6 is a partial side view in longitudinal section and to a larger scale of a third embodiment of a spray nozzle in accordance with the invention.
Figure 7:
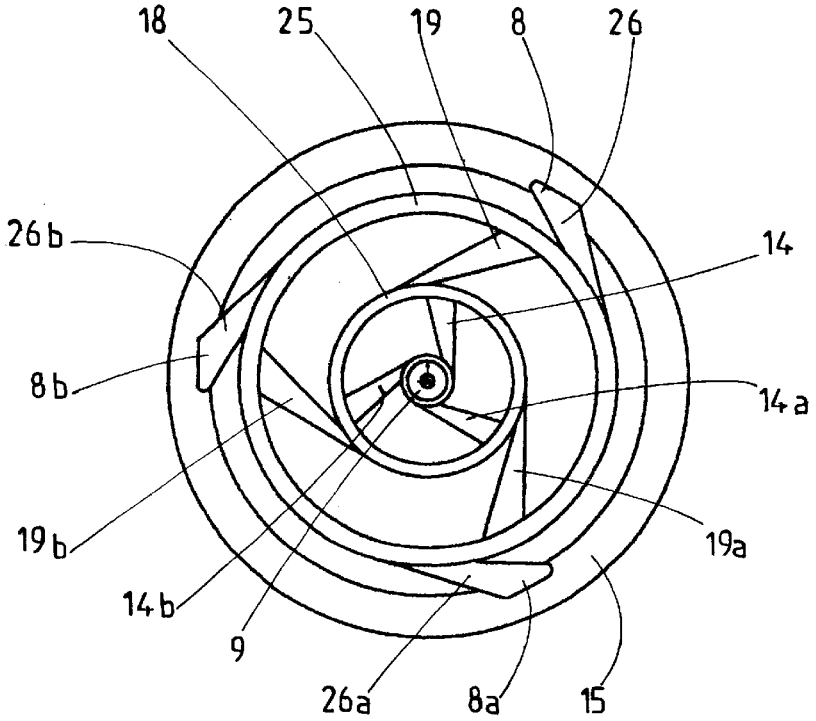
FIG. 7 is a rear view of the posterior face of an anterior plate of the embodiment shown in FIG. 6.
Figure 8:
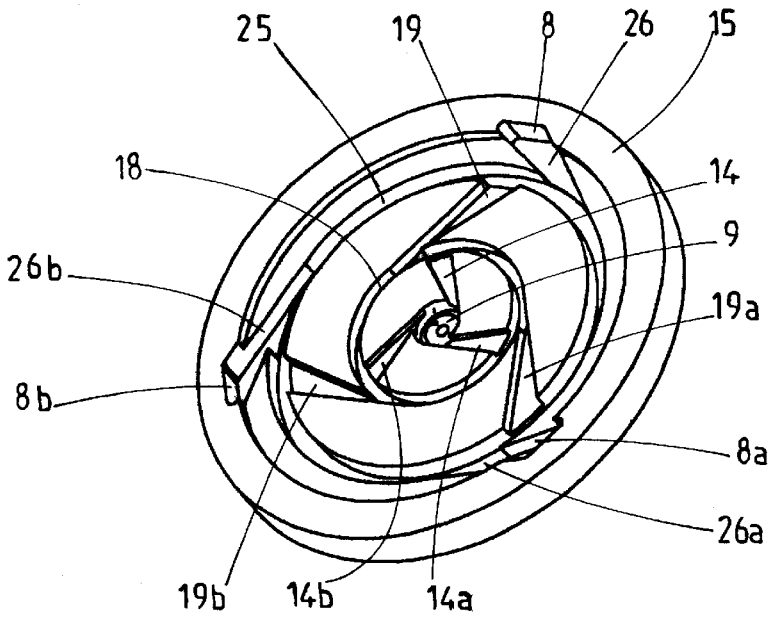
FIG. 8 is a perspective view of the posterior face of the anterior plate shown in FIG. 7.

In the embodiment shown in FIGS. 6 to 8, there are three fluid inlet passages 14, 14*a* and 14*b* connecting the central swirl chamber 9 to a first common intermediate coaxial annular chamber 18, in turn connected to a second common intermediate coaxial annular chamber 25 by three intermediate passage 19, 19*a* and 19*b* injecting the fluid tangentially into the first common coaxial annular chamber 18 so that the fluid rotates in the direction opposite to that in which it rotates in the central swirl chamber 9. The second common intermediate coaxial annular chamber 25 is itself connected to peripheral anterior cavities 8, 8*a* and 8*b* and to the peripheral fluid inlet passages 6 and 7 by three intermediate passages 26, 26*a* and 26*b* injecting the fluid tangentially into the second common coaxial annular chamber 25 so that it rotates in the same direction as that in which it rotates in the central swirl chamber 9.

In another embodiment, a spring member can be engaged between the posterior plate 5*b* and the posterior core body 5*a*, to allow reversible expansion under load of the lateral fluid inlet passage(s) 14 and the central swirl chamber 9.

A number of inlet passages other than 1 or 3 or more, and a number of stages other than 1 or 3 could naturally be provided.

The coaxial outlet passage 12 can advantageously be frustoconical with a half-angle at the apex in the range from 0° to 3°, and converging towards the outlet.

Because of the particular structure of the nozzle in accordance with the invention, with attached plates 15 and 5*b* between a hollow nozzle body 1 and a posterior core body 5*a*, the external parts (hollow nozzle body 1 and posterior core body 5*a*) providing the mechanical strength of the nozzle can be manufactured separately, and from the interior parts (anterior plate 15 and posterior plate 5*b*) defining the dimensions of the fluid inlet passages, such as the passage 14, the central swirl chamber 9, the coaxial outlet passage 12 and the axial posterior recess 17. It is then possible to make the anterior plate 15 and the posterior plate 5*b* from a different material than the external parts 1 and 5, and using different manufacturing methods, so that the central swirl chamber 9, the coaxial outlet passage 12, and the fluid inlet passages such as the passage 14 can be manufactured with great accuracy.

It is therefore possible to manufacture economically fluid inlet passages such as the passage 14, and a central swirl chamber 9 with a coaxial outlet passage 12 and axial posterior recesses 17 whose dimensions are very accurate, achieving satisfactory reproducibility of the characteristics of the sprayed jet of fluid in outlet.

It is particularly advantageous and economical to use a plate such as the generally plane anterior plate 15, so that the fluid inlet passages such as the passage 14 are parallel to the posterior face of the anterior plate 15.

The present invention is not limited to the embodiments explicitly describes, but encompasses variants and generalizations thereof within the scope of the following claims.

What is claimed is:

1. Spray nozzle having:

a hollow nozzle body (1) with a peripheral external wall (2) having a longitudinal axis (I—I) and a radial anterior external wall (3) incorporating an axial outlet hole (4), a central swirl chamber (9) delimited by a peripheral wall (10) with a shape of revolution about the longitudinal axis (I—I), an anterior wall (11) incorporating a coaxial outlet passage (12) smaller than the axial outlet hole (4), and a posterior wall (13), at least one lateral fluid inlet passage (14) in the peripheral wall (10), opening into the central swirl chamber (9) and shaped to inject the fluid tangentially into the central swirl chamber (9), an anterior plate (15) fastened into the hollow nozzle body (1) and bearing against the radial anterior external wall (3), incorporating posterior openings and grooves forming the peripheral (10) and anterior (11) walls at least of the central swirl chamber (9), the coaxial outlet passage (12), and said at least one lateral fluid inlet passage (14), and a posterior core (5) fitted into the hollow nozzle body (1), and having peripheral fluid feed passages (6, 7), and an anterior face (16) pushing said at least one attached anterior plate (15) towards said radial anterior external wall (3) of the hollow nozzle body (1), wherein :

the posterior core (5) comprises a posterior core body (5*a*), retained in the hollow nozzle body (1) by fixing means, and a posterior plate (5*b*) held in position by the posterior core body (5*a*) and bearing axially against the anterior plate (15) to form the posterior wall (13) of the central swirl chamber (9) and to delimit said at least one fluid inlet passage (14) towards the rear, the anterior (15) and posterior (5*b*) plates are provided with relative centering means for centering the plates (15, 5*b*) relative to each other about the longitudinal axis (I—I), the posterior plate (5*b*) comprises, along the longitudinal axis (I—I), a posterior recess (17) with a smaller cross section than the central swirl chamber (9), at least one of the anterior (15) and posterior (5*b*) plates is mounted with radial clearance in the hollow nozzle body.

2. Spray nozzle according to claim 1, wherein the relative centering means for the plates (15, 5*b*) are on their respective front bearing faces.

3. Spray nozzle according to claim 1, wherein the relative centering means for the plates (15, 5*b*) comprise a posterior peripheral rib (20) on the anterior plate (15) in which the periphery (21) of the posterior plate (5*b*) engages.

4. Spray nozzle according to claim 1, wherein a spring member is engaged between the posterior plate (5*b*) and the posterior core body (5*a*), to allow reversible expansion under load of said at least one lateral fluid inlet passage (14) and said central swirl chamber (9).

5. Spray nozzle according to claim 1, wherein, characterized in that it comprises a plurality of lateral inlet passages (14, 14*a*, 14*b*) regularly distributed at the periphery of the central swirl chamber (9).

6. Spray nozzle according to claim 5, wherein the lateral inlet passages (14, 14*a*, 14*b*) connect the central swirl chamber (9) to a first common intermediate coaxial annular chamber (18) itself connected to a second common intermediate coaxial annular chamber (25) by a plurality of intermediate passages (19, 19*a*, 19*b*) injecting the fluid tangentially into the first common coaxial annular chamber (18) so that the fluid rotates in the direction opposite to that in which it rotates in the central swirl chamber (9), the second common intermediate coaxial annular chamber (25) being itself connected to peripheral anterior cavities (8, 8*a* and 8*b*) and to the peripheral fluid feed passages (6, 7) by a plurality of intermediate passages (26, 26*a* and 26*b*) injecting the fluid tangentially into the second common coaxial annular chamber (25) so that it rotates in the same direction as that in which it rotates in the central swirl chamber (9).

* * * * *